US007445329B2

(12) United States Patent
Yoshida

(10) Patent No.: US 7,445,329 B2
(45) Date of Patent: Nov. 4, 2008

(54) IMAGE FORMING APPARATUS

(75) Inventor: Yasunari Yoshida, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/939,987

(22) Filed: Nov. 14, 2007

(65) Prior Publication Data

US 2008/0111852 A1 May 15, 2008

(51) Int. Cl.
*B41J 2/01* (2006.01)

(52) U.S. Cl. ..... 347/104

(58) Field of Classification Search ..... 347/15, 347/16, 41, 12, 104, 105; 271/3.17, 3.2, 271/3.21, 9.1, 10.01, 104, 130, 166, 270; 400/582, 583; 399/395
See application file for complete search history.

(56) References Cited

U.S. PATENT DOCUMENTS 6,827,421 B2 12/2004 Nunokawa et al.
6,843,546 B2 * 1/2005 Nunokawa ..... 347/15
7,387,355 B2 * 6/2008 Kakutani ..... 347/15

FOREIGN PATENT DOCUMENTS

JP 2002-283543 10/1992
JP 2003-320719 11/2003

* cited by examiner

*Primary Examiner*—Lamson D Nguyen
(74) *Attorney, Agent, or Firm*—Scully, Scott, Murphy & Presser, P.C.

(57) ABSTRACT

A recording unit is movable in a first direction and has a plurality of dot forming portions arranged in a predetermined interval in a second direction that intersects the first direction. A conveying roller conveys the recording medium in the second direction. Recording operations and conveying operations are repeated for forming an image. A setting unit sets a number of effective dot forming portions used in a single recording operation such that a length in the second direction corresponding to the number of effective dot forming portions equals to either an even number times one half of circumference of the conveying roller or a value that is closest to an even number times one half of circumference of the conveying roller, when a required interval of dots formed on the recording medium in the second direction is less than or equal to one half of the predetermined interval.

13 Claims, 7 Drawing Sheets

IMAGE FORMING APPARATUS

CROSS REFERENCE TO RELATED APPLICATIONS

This application claims priority from Japanese Patent Application No. 2006-307506 filed Nov. 14, 2006. The entire content of the priority application is incorporated herein by reference.

TECHNICAL FIELD

The invention relates to an image forming apparatus.

BACKGROUND

One type of inkjet printer well known in the art forms images on a recording medium by repeatedly and alternately executing a recording operation for reciprocating a print head in a main scanning direction while the print head ejects ink onto the recording medium, and a conveying operation for conveying the recording medium in a subscanning direction. However, this type of inkjet printer does not have a recording head with a nozzle pitch capable of matching recent improvements in recording density. Thus, to improve recording density with this inkjet printer, techniques have been employed to eject additional ink droplets for filling gaps between the nozzles.

Japanese Patent Application Publication No. 2002-283543 discloses one such method for recording with a recording head having N nozzles formed at a nozzle pitch L. In order to achieve a recording density of L/3 in the subscanning direction with this technique, recording is performed while conveying the recording head L/3 in the subscanning direction twice and subsequently conveying the recording head $(N-1+\frac{1}{3})L$ in a subscanning direction and repeating this operation.

However, error is produced in the conveying distance of the recording medium because the conveying rollers cannot convey the recording medium according to the theoretical value. Specifically, the conveying rollers have mechanical error due to the shape or eccentricity of the roller, Consequently, while the conveying roller rotates one time from a predetermined rotating start position, error in the conveying distance of the recording medium caused by the conveying roller changes within one cycle of a sine wave with the rotating start position set to 0.

The technique disclosed in Japanese Patent Application Publication No, 2002-283543 described above sets one unit of conveyance as a combination of two conveying operations at L/3 and one conveying operation at $(N-1+\frac{1}{3})L$. When a plurality of recording operations have been performed in these units of conveyance, recording in one unit of conveyance have deviated from recording in another unit of conveyance. This positional deviation produces what is called "banding" (irregular streaks of ink), preventing this technique from forming high-quality images.

SUMMARY

In view of the foregoing, it is an object of the invention to provide an image forming apparatus capable of forming high-quality images, even when a conveying roller produces error in a conveying distance of a recording medium.

In order to attain the above and other objects, the invention provides an image forming apparatus. The image forming apparatus includes a recording unit, a conveying roller, and a setting unit. The recording unit is movable in a first direction and has a plurality of dot forming portions arranged in a predetermined interval in a second direction that intersects the first direction. The conveying roller conveys the recording medium in the second direction. The recording unit and the conveying roller are configured in such a manner that recording operations by the recording unit and conveying operations by the conveying roller are repeated for forming an image on a recording medium. The setting unit sets a number of effective dot forming portions used in a single recording operation such that a length in the second direction corresponding to the number of effective dot forming portions equals to either an even number times one half of circumference of the conveying roller or a value that is closest to an even number times one half of circumference of the conveying roller, when a required interval of dots formed on the recording medium in the second direction is less than or equal to one half of the predetermined interval.

According to another aspect, the invention also provides an image forming apparatus. The image forming apparatus includes a recording unit, a conveying roller, and a setting unit. The recording unit is movable in a first direction and has a plurality of dot forming portions arranged in a predetermined interval in a second direction that intersects the first direction. The conveying roller conveys the recording medium in the second direction. The recording unit and the conveying roller are configured in such a manner that recording operations by the recording unit and conveying operations by the conveying roller are repeated for forming an image on a recording medium. The setting unit sets an number of effective dot forming portions used in a single recording operation such that a length in the second direction corresponding to the number of effective dot forming portions equals to either an odd number times one half of circumference of the conveying roller or a value that is closest to an odd number times one half of circumference of the conveying roller, when a required interval of dots formed on the recording medium in the second direction is less than or equal to one half of the predetermined interval.

According to still another aspect, the invention also provides an image forming apparatus. The image forming apparatus includes a recording unit, a conveying roller, and a setting unit. The recording unit is movable in a first direction and has a plurality of dot forming portions arranged in a predetermined interval in a second direction that intersects the first direction. The conveying roller conveys the recording medium in the second direction. The recording unit and the conveying roller are configured in such a manner that recording operations by the recording unit and conveying operations by the conveying roller are repeated for forming an image on a recording medium. When a required interval of dots formed on the recording medium in the second direction is less than or equal to one half of the predetermined interval, the setting unit sets a number Q of effective dot forming portions used in a single recording operation to a maximum number that satisfies an equation: $Q=M\times 1/P\times L/2$, where M is a natural number, P is the predetermined interval of the plurality of dot forming portions, and L is the circumference of the conveying roller. The number Q of effective dot forming portions is less than or equal to the number of the plurality of dot forming portions in the second direction.

BRIEF DESCRIPTION OF THE DRAWINGS

Embodiments in accordance with the invention will be described in detail with reference to the following figures wherein.

DETAILED DESCRIPTION

An image forming apparatus according to an embodiment of the invention will be described while referring to FIGS. 1 through 6.

The embodiment pertains to a color laser printer 1. In the following description, the expressions "front", "rear", "upper", "lower", "right", and "left" are used to define the various parts when the color laser printer 1 is disposed in an orientation in which it is intended to be used.

The color inkjet printer 1 includes four ink cartridges filled with one of the ink colors cyan (C), magenta (M), yellow (Y), and black (Bk) and performs printing operations by ejecting ink supplied from these ink cartridges onto a recording medium (hereinafter referred to as a "recording paper P"). The printer 1, is configured to alternately execute a recording operation and a conveying operation for conveying the recording paper P.

Figure 1:
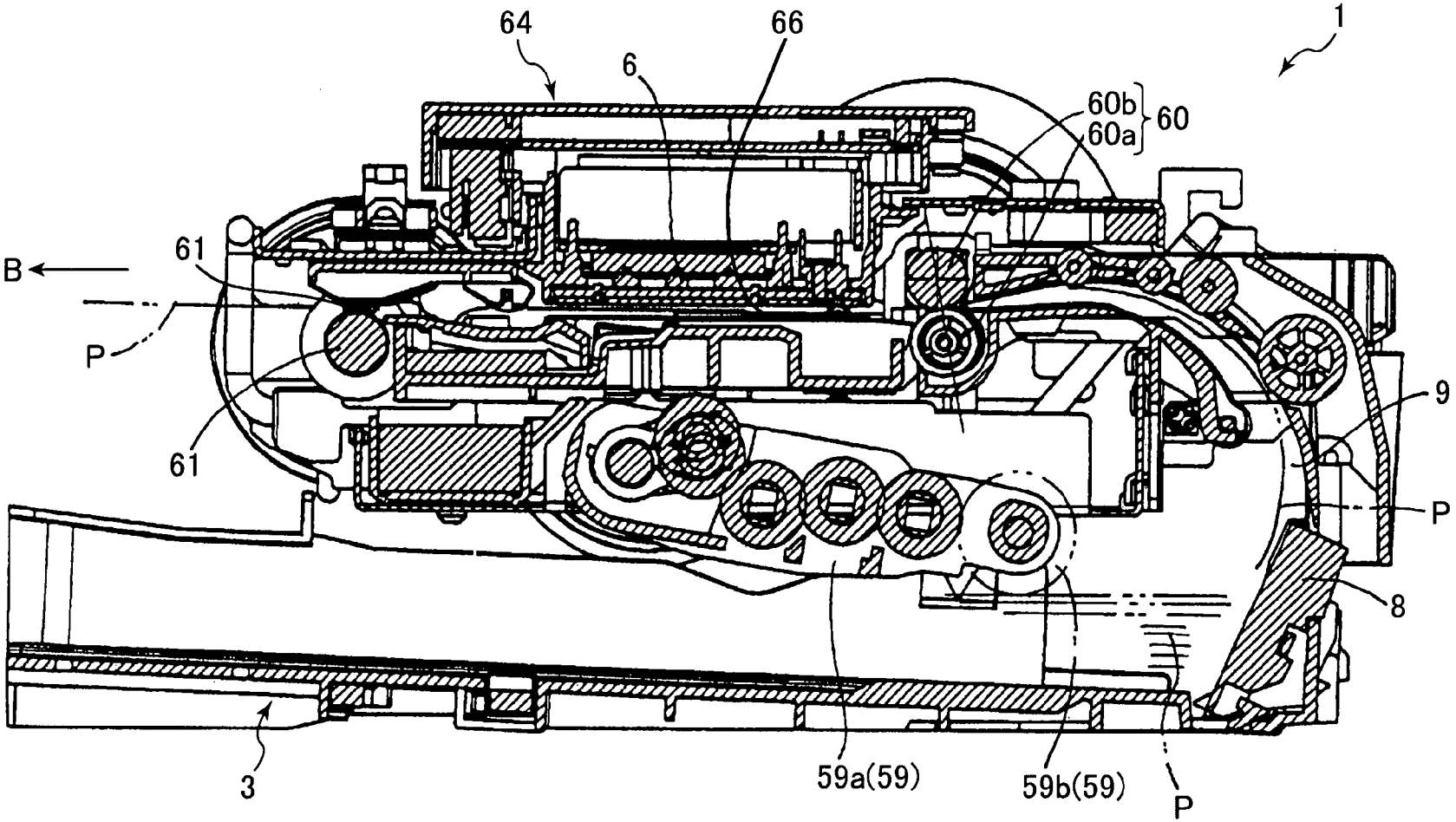
FIG. 1 is a vertical cross-sectional view showing a color inkjet printer embodying an image forming apparatus according to an embodiment of the invention.

As shown in FIG. 1, a paper cassette 3 and a feeding unit 59 are provided on the bottom of the printer 1. The paper cassette 3 is capable of accommodating a plurality of stacked sheets of recording paper P cut to A4 size, letter size, postcard size, or the like such that the shorter edges of the recording paper P are aligned with a main scanning direction (orthogonal to a paper-conveying direction and the surface of the drawing in FIG. 1).

The feeding unit 59 functions to convey the recording paper P stacked in the paper cassette 3 toward an inkjet head G. The feeding unit 59 includes an arm 59*a* disposed above the paper cassette 3, and a pickup roller 59*b* rotatably provided on a distal end of the arm 59*a*. The arm 59*a* is capable of pivoting about an end opposite the distal end so that the distal end moves up and down.

The pickup roller 59*b* is connected to a linefeed motor 40 (see FIG. 3) via a transmission mechanism including gears and the like (not shown). A drive force from the linefeed motor 40 drives the pickup roller 59*b* to rotate counterclockwise in FIG. 1 for conveying the recording paper P in the paper-conveying direction. When a request has been made for a printing operation, the arm 59*a* is pivoted downward until the pickup roller 59*b* contacts the recording paper P stacked in the paper cassette 3. When driven in the paper-conveying direction, the pickup roller 59*b* conveys the recording paper P from the paper cassette 3 downstream in the paper-conveying direction.

A sloped separating plate 8 for separating sheets of the recording paper P is disposed in the rear side of the paper cassette 3 (right side in FIG. 1). The separating plate 8 separates sheets of the recording paper P fed from the paper cassette 3 so that the sheets are conveyed one at a time. The separated sheets of recording paper P are conveyed along a U-shaped path 9 to a pair of conveying rollers 60 disposed above (at a higher position than) the paper cassette 3. The pair of conveying rollers 60 is configured of a drive roller 60*a* and a follow roller 60*b*. The drive roller 60*a* is connected to the linefeed motor 40 and is provided with a drive force. The follow roller 60*b* follows rotation of the drive roller 60*a*.

Downstream of the conveying rollers 60, the printer 1 includes the inkjet head 6, a carriage 64 on which the inkjet head 6 is supported, and a platen 66 disposed in opposition to the inkjet head 6. Discharge rollers 61 are disposed farther downstream of the inkjet head 6 for pinching and conveying the recording paper P after the recording paper P passes over the surface of the platen 66 confronting the inkjet head 6. The conveying rollers 60 and discharge rollers 61 convey the recording paper P in a subscanning direction indicated by the arrow B in FIG. 1 so that after passing under the inkjet head 6 the recording paper P is discharged from the printer 1 through a discharge opening.

The printer 1 also accommodates a carriage shaft extending in the main scanning direction parallel to the platen 66 for achieving reciprocating movement of the carriage 64, a guide member disposed parallel to the carriage shaft for supporting the carriage 64, two pulleys provided one near each end of the carriage shaft, and a timing belt looped around the pulleys and fixed at one point to the carriage 64. A carriage motor 16 (see FIG. 3) is provided for rotating one of the pulleys forward or in reverse, at which time the carriage 64 fixed to the timing halt reciprocates in the main scanning direction along with the forward rotation or reverse rotation of the pulley, moving over the carriage shaft and the guide member.

A linear encoder 43 (see FIG. 3) for detecting the position of the carriage 64 has an encoder strip that extends in the main scanning direction. The linear encoder 43 detects the current position of the carriage.

Although not shown in the drawings, the printer 1 also includes ink cartridges accommodating ink of four colors (black, cyan, magenta, and yellow) for recording full color images; a plurality of ink tubes for supplying ink from the ink cartridges to the inkjet head 6; and the like.

Figure 2:
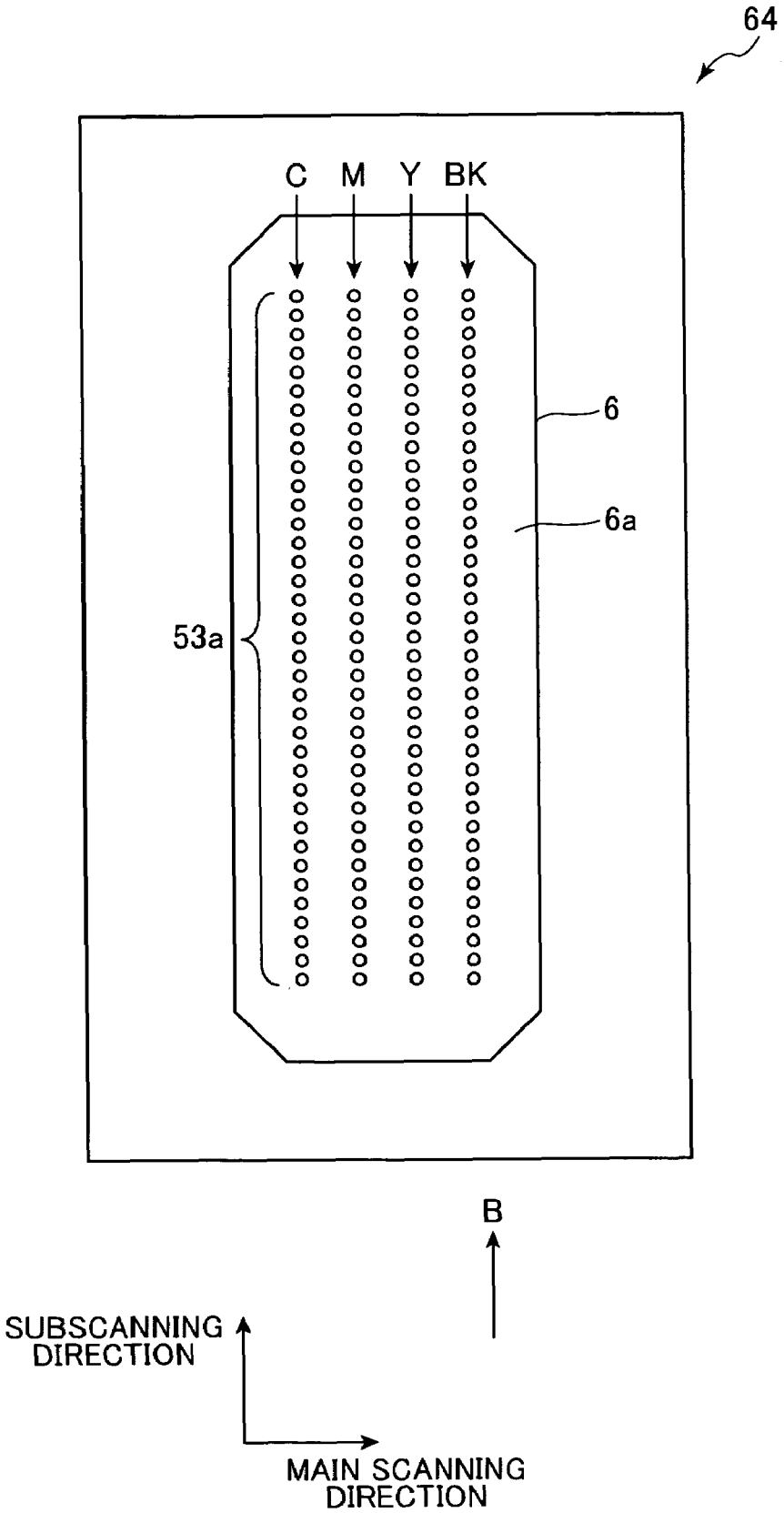
FIG. 2 is an explanatory diagram showing a bottom surface of a carriage in the color inkjet printer.

FIG. 2 shows a bottom surface 6*a* of the inkjet head 6, which is the surface confronting the recording paper P. As shown in FIG. 2, rows of nozzles 53*a* are formed in the bottom surface 6*a* of the inkjet head 6, with one row for each of the ink colors cyan, magenta, yellow and black. The rows are aligned with the paper-conveying direction B, which is the subscanning direction. The number and pitch of nozzles 53*a* in each row is set appropriately according to the resolution of the recorded image and the like. The number of rows of nozzles 53*a* may also be increased or decreased to match the number of ink colors.

In the embodiment, a total of 148 nozzles are formed in the inkjet head 6. The nozzles are assigned numbers from nozzle No. 00 to nozzle No. 147 in order along the subscanning direction. The nozzles are formed at a pitch of 150 dpi.

Figure 3:
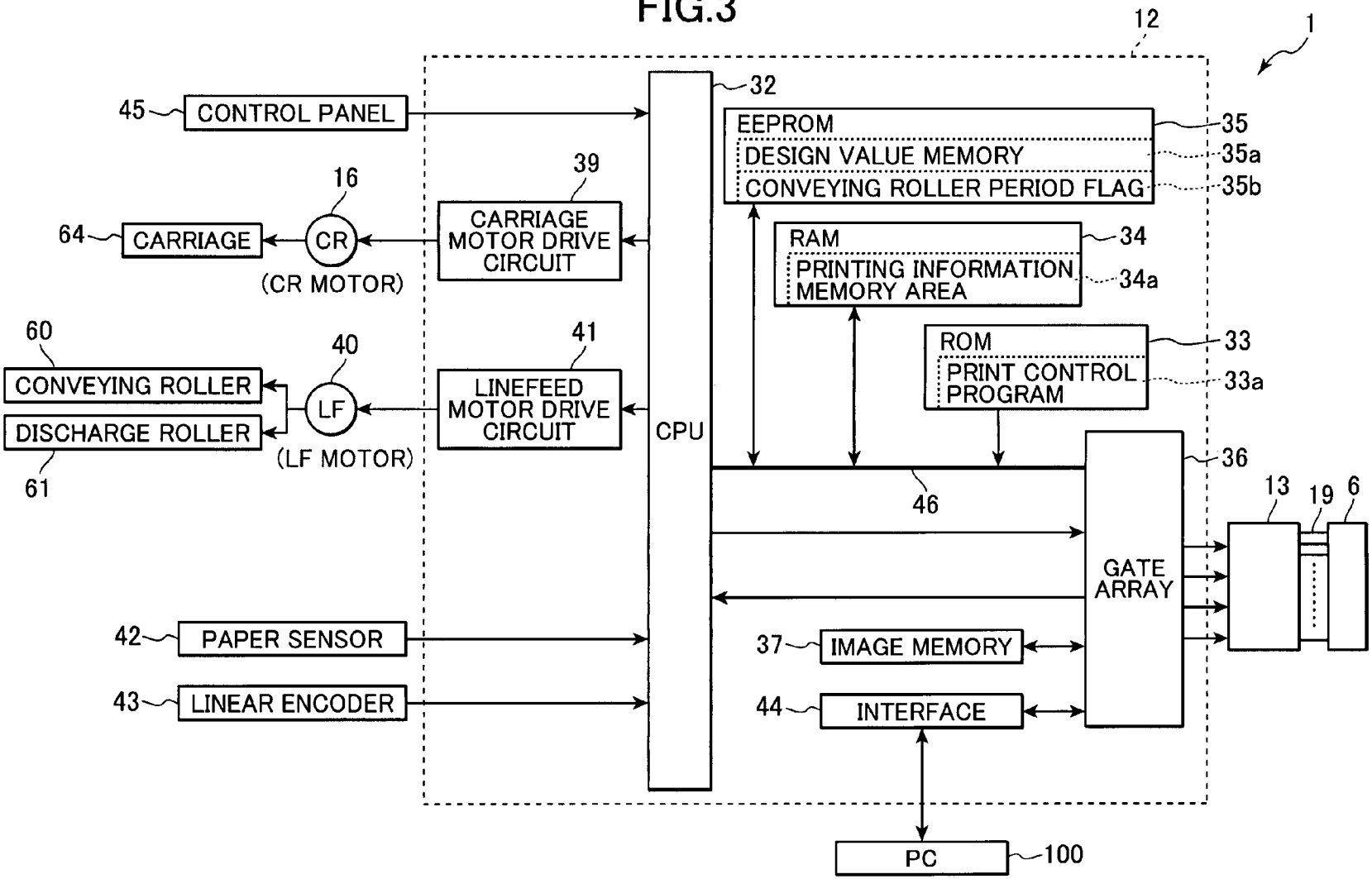
FIG. 3 is a block diagram showing the overall electric circuit structure of the color inkjet printer.

FIG. 3 is a block diagram showing the general structure of an electric circuit in the printer 1. A controller for controlling the printer 1 is configured of a control circuit board 12 provided in the body of the printer 1, and a carriage circuit board 13. Mounted on the control circuit board 12 are a single-chip microcomputer (CPU) 32, a ROM 33 storing various control programs executed by the CPU 32 and fixed values, a RAM 34 for temporarily storing various data, an EEPROM 35, an image memory 37, and a gate array 36.

The CPU 32 generates a print timing signal and a reset signal according to the control program stored in the ROM 33 and transfers these signals to the gate array 36 described below. The CPU 32 is connected to a control panel 45 via which the user can input a print command and the like, a carriage motor drive circuit 39 for driving the carriage motor 16, a linefeed motor drive circuit 41 for driving the linefeed motor 40, a paper sensor 42, and the linear encoder 43. The CPU 32 controls the operations of each device connected thereto.

The paper sensor 42 is disposed upstream of the conveying rollers 60 and functions to detect the leading edge of the recording paper P. As an example, the paper sensor 42 may be configured of a probe that pivotally moves when contacted by the recording paper P, and a photointerrupter for detecting pivotal movement of the probe. The conveying distance from the paper sensor 42 to the inkjet head 6 is known because the paper sensor 42 is disposed in a fixed position and the position of the inkjet head 6 is also fixed.

Further, the distance in which the recording paper P has been conveyed can also be acquired by detecting a drive amount of the linefeed motor 40, which is driven to convey the recording paper P Since the linefeed motor 40 is configured of a stepping motor, the drive amount of the linefeed motor 40 can be determined by counting pulse signals outputted from the CPU 32 to the linefeed motor drive circuit 41.

Therefore, the recording paper P can be fed to a recording start position by driving the linefeed motor 40 until the drive amount of the linefeed motor 40 after the paper sensor 42 detects the leading edge of the recording paper P reaches a pulse number equivalent to the distance from the detection position of the paper sensor 42 to the recording start position.

The linear encoder 43 is configured of the encoder strip described above interposed between a light-emitting element on one side and a light-receiving element on the other. The linear encoder 43 functions to detect the amount of movement of the carriage 64. The light-emitting element and light-receiving element are mounted on the carriage 64 at predetermined locations and move together with the carriage 64 as the carriage 64 reciprocates in the main scanning direction. The CPU 32 detects the position of the carriage 64 based on an encoder signal outputted from the light-receiving element of the linear encoder 43 and controls the reciprocating motion of the carriage 64 accordingly.

Figure 6:
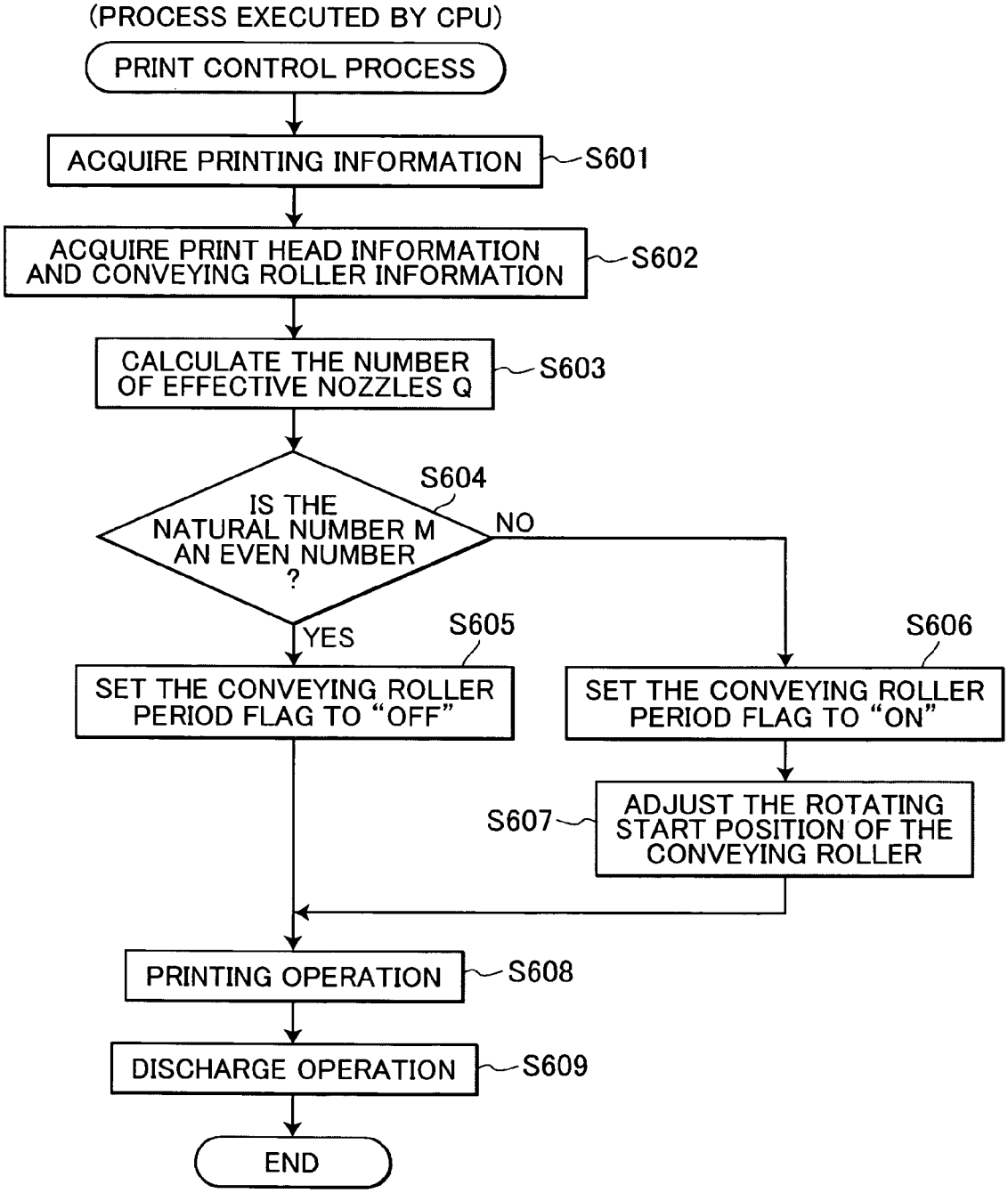
FIG. 6 is a flowchart illustrating steps in a printing process according to the embodiment.

The ROM 33 stores a print control program 33*a* for controlling printing operations performed with the printer 1. A program for implementing the printing process in the flowchart of FIG. 6 is stored in the ROM 33 as part of the print control program 33*a*.

The RAM 34 has a printing information memory area 34*a*. The printing information memory area 34*a* stores printing information included in print data received from a personal computer (hereinafter abbreviated as "PC") 100. The print data transmitted from the PC 100 includes not only image data, but also printing information necessary for printing.

The printing information includes information on the type and size of the recording paper P, the recording density, and the printing method, such as borderless printing or normal printing, and is generated by a printer driver installed on the PC 100, for example. Upon receiving print data from the PC 100, the printer 1 writes the printing information included in the print data to the printing information memory area 34*a*.

The EEPROM 35 is a rewritable, nonvolatile is memory capable of saving stored data even after the power to the printer 1 is turned off. The EEPROM 35 includes a design value memory 35*a*, and a conveying roller period flag 35*b*.

The design value memory 35*a* stores specifications of the inkjet head 6 (length, number of nozzles, and nozzle pitch), a conveying distance corresponding to the required recording density stored in the printing information memory area 34*a*, and specifications of the drive roller 60*a* of the conveying rollers 60 (circumference L and rotating start position).

Next, the rotating start position data in the specifications of the conveying rollers 60 will be described. When making one rotation from the predetermined rotating start position, the conveying rollers 60 produce error in the conveying distance of the recording paper P in one cycle of a sine wave (sine curve), with error in the conveying distance set to 0 at the rotating start position. The rotating start position data can identify this rotating start position and is detected and stored at the factory prior to shipping. More specifically, the rotating start position is detected as follows.

(1) The LF motor 40 is driven to rotate the conveying roller 60 for one and half rotations, while the LF motor 40 is stopped at each predetermined pulse (predetermined angle) and the carriage 64 is scanned to print a horizontal line on a recording medium. By this operation, a plurality of horizontal lines is formed on the recording medium.

(2) The recording medium on which the horizontal lines are formed is placed on an optical image evaluation apparatus.

(3) Pitches (distances) between the adjacent horizontal lines are measured by the optical image evaluation apparatus.

(4) The measured pitches are plotted for one rotation of the conveying roller 60 and are approximated by a sine curve. Based on this sine curve, a step number corresponding to an angle of 0 (or $\pi$) is determined, and the step number is stored in the design value memory 35*a* of the EEPROM 35 as the rotating start position data.

The conveying roller period flag 35*b* indicates whether the number of nozzles used in a single recording operation is an even multiple or an odd multiple of the semi-circumference L/2 of the conveying roller. The CPU 32 is connected to the ROM 33, RAM 34, EEPROM 35, and gate array 36 via a bus line 46.

The gate array 36 outputs various signals based on a timing signal transferred from the CPU 32 and image data stored in the image memory 37, including recording data (drive signals) for recording the image data on the recording paper P, a transfer clock for synchronizing with the recording data, a latch signal, a parameter signal for generating a basic drive waveform signal, and an ejection timing signal outputted at a fixed period. These signals are transferred to the carriage circuit board 13 on which a head driver is mounted.

When an external device such as the PC 100 transfers image data to the gate array 36 via a USB or other interface 44, the gate array 36 stores the image data in the image memory 37. The gate array 36 then generates a data reception interrupt signal based on data transferred from the PC 100 or the like via the interface 44 and transfers this signal to the CPU 32. The signals are transferred between the gate array 36 and the carriage circuit board 13 via a harness cable connecting the two.

The carriage circuit board 13 functions to drive the inkjet head 6 through the mounted head driver (drive circuit). The head driver is connected to the inkjet head 6 via a flexible circuit board 19 configured of a copper foil wiring pattern formed on a polyimide film having a thickness of 50-150 μm. The CPU 32 controls the head driver through the gate array 36 mounted on the control circuit board 12 to apply drive pulses of a waveform conforming to the recording mode to piezoelectric actuators in the inkjet head 6, thereby ejecting ink of a predetermined amount.

Next, a recording operation according to the embodiment will be described with reference to FIGS. 4A through 5. In the embodiment, the nozzles 53*a* have a nozzle pitch of 150 dpi. When a recording density of 600 dpi in the subscanning direction is requested, the printer 1 conveys the recording medium three times at the first conveying amount, and subsequently conveys the recording medium one time at a second conveying amount greater than the first conveying amount. The combination of these four conveying operations is considered one unit of conveyance) and the printer 1 conveys the recording medium a plurality of times at this unit of conveyance. The following description is an example for achieving a recording density of 600 dpi.

Figure 4A:
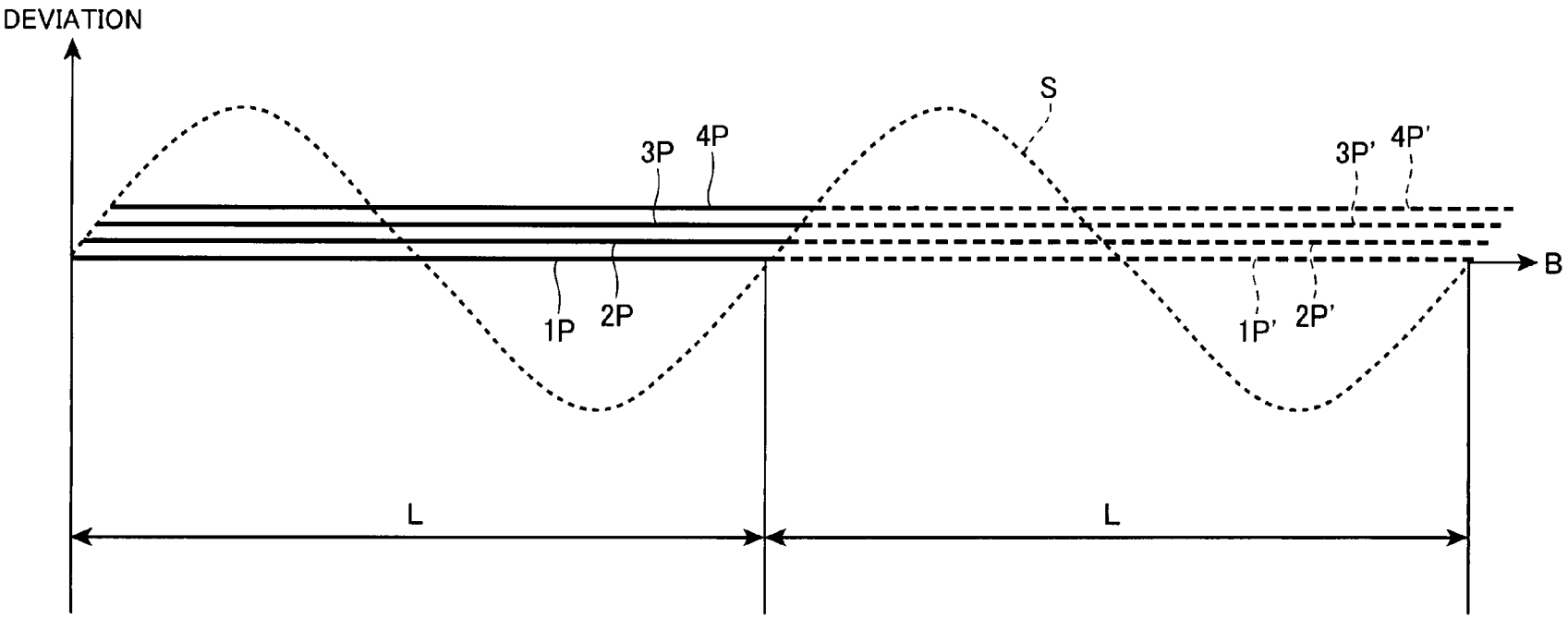
FIG. 4A is an explanatory diagram illustrating a recording method according to the embodiment.
Figure 4B:
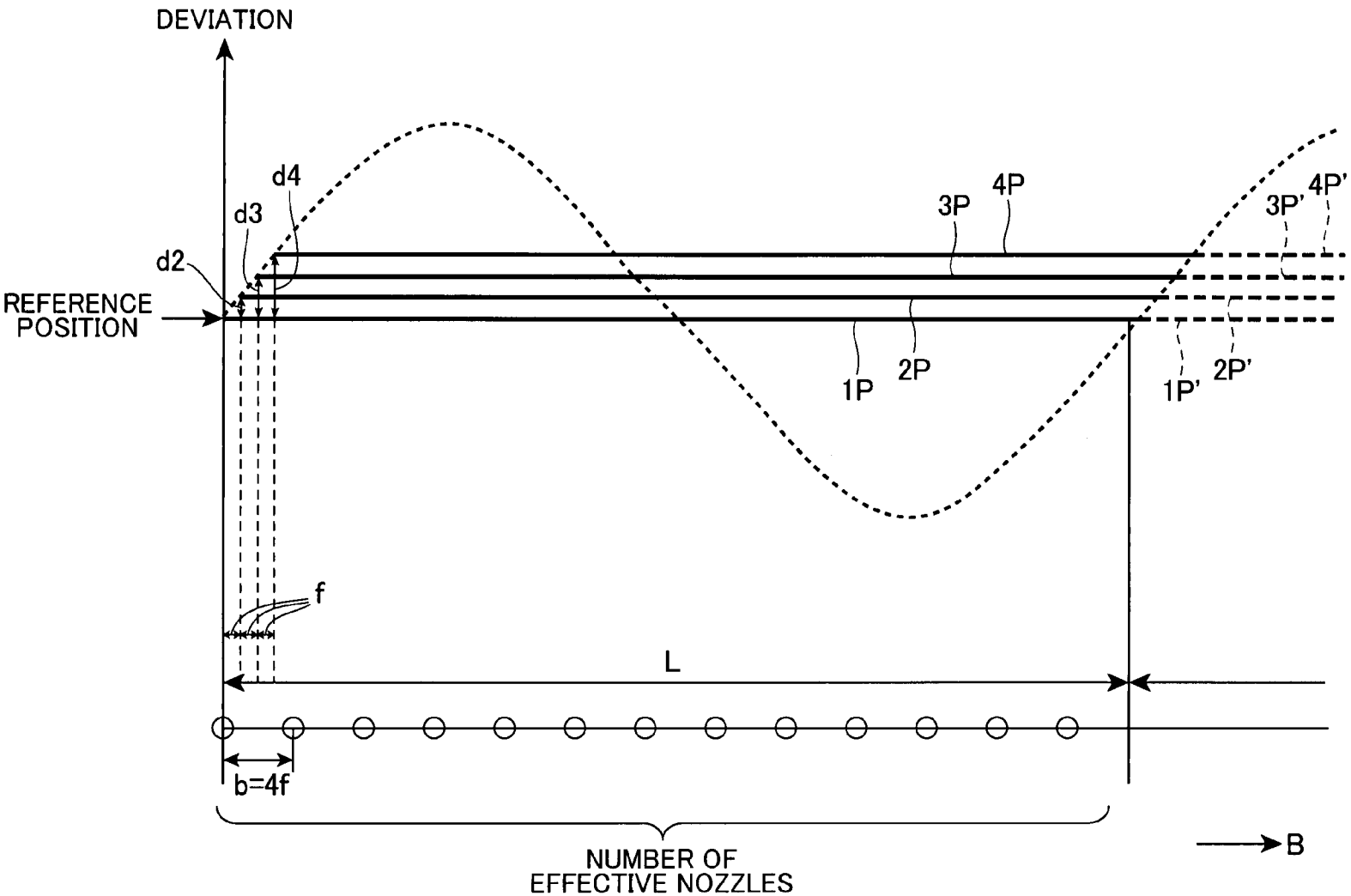
FIG. 4B is an explanatory diagram showing an example of deviations of lines from a reference position and the number of effective nozzles used in a single recording operation.
Figure 5:
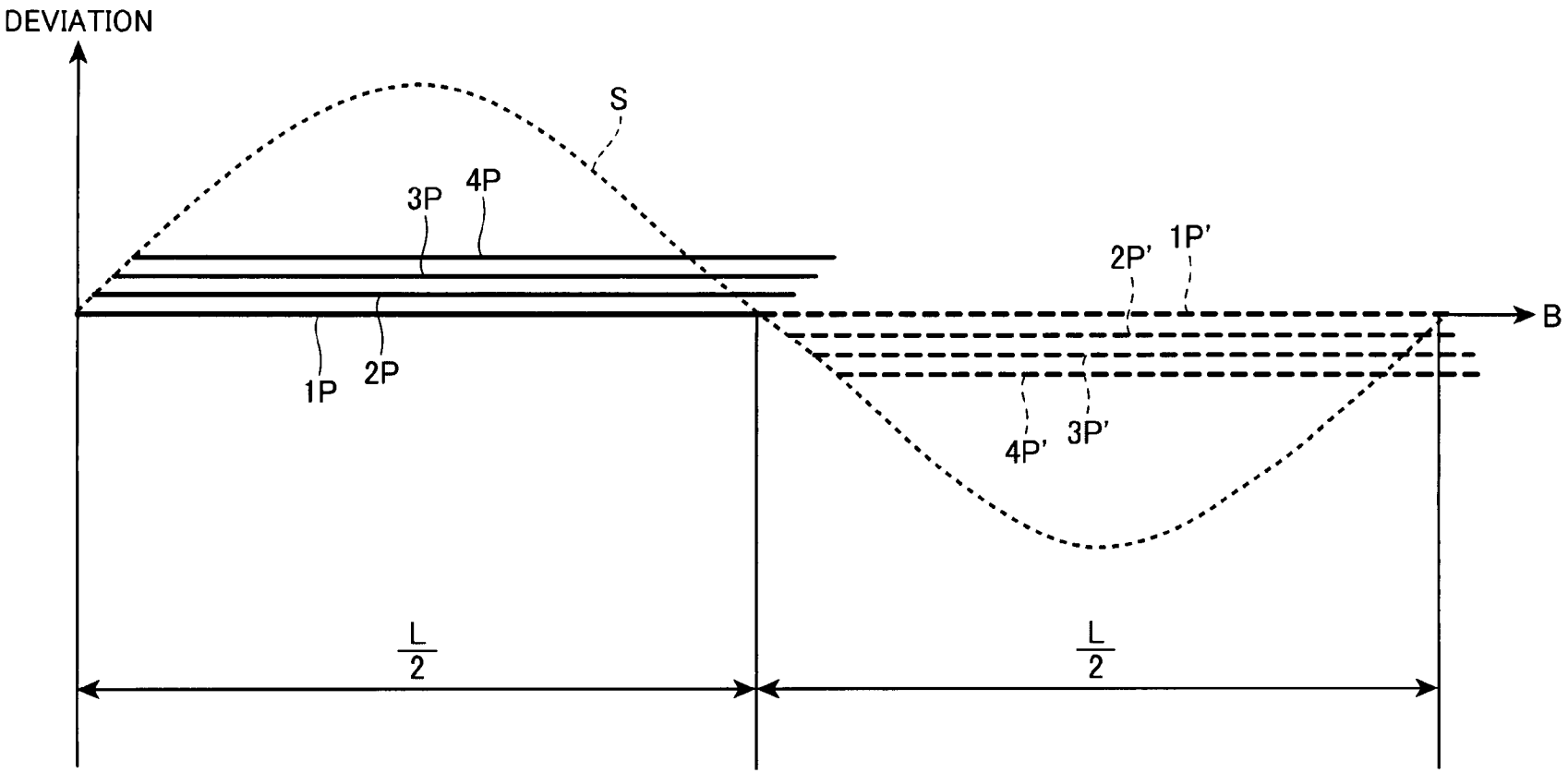
FIG. 5 is an explanatory diagram illustrating another recording method according to the embodiment.

FIGS. 4A through 5 are explanatory diagrams superposing a sine wave S indicating a change in deviation (error) in the conveying distance of the recording paper P from the theoretical conveying distance, and a conceptual image recorded according to the recording method of the embodiment.

In the recording method shown in FIGS. 4A and 4B, when the requested pitch of dots recorded in the subscanning direction of the recording paper P is less than or equal to one-half the pitch of the nozzles 53*a*, the number of nozzles 53*a* used in one recording operation by the inkjet head 6 is set such that a length in the subscanning direction corresponding to the number of nozzles 53*a* equals to an even multiple of the semi-circumference L/2 of the conveying roller 60 (more specifically, the drive roller 60*a*).

As described above, the conveying rollers 60 have mechanical error caused by their shape and eccentricity that produces deviation in the conveying distance of the recording paper P. This deviation is indicated by the sine wave S, where one period of the sine wave S corresponds to one rotation of the conveying roller 60 from the predetermined rotating start position. Deviation at the rotating start position is set to 0. Hence, the interval for one cycle of the sine wave S corresponds to the circumference L of the conveying roller 60 (two times (an even multiple) of the semi-circumference L/2 of the conveying roller 60).

The conceptual image recorded in the recording method of the embodiment includes straight lines 1P-4P indicated by solid lines, and straight lines 1P'-4P' indicated by dotted lines. In order to produce the required recording density, the printer 1 records the 1P in the first recording operation, followed by a small feed, records the 2P in the second recording operation, followed by a small feed, records the 3P in the third recording operation, followed by a small feed, and records the 4P in the fourth is recording operation, followed by a large feed, thus recording the four lines 1P-4P.

Subsequently, the printer 1 records the 1P' in the first recording operation, followed by a small feed, records the 2P' in the second recording operation, followed by a small feed, records the 3P' in the third recording operation, followed by a small feed, and records the 4P' in the fourth recording operation, followed by a large feed. In this way, the printer 1 records each of the dotted lines 1P'-4P'.

While each of the lines 1P-4P and 1P'-4P' are recorded by dots separated by predetermined intervals in the same line, the 1P-4P are represented by continuous straight lines and the 1P'-4P' are represented by dotted lines to facilitate understanding. Further, images recorded in each recording operation of a unit of conveyance have been separated vertically in FIG. 4.

Further, the nozzles 53*a* used for recording the 1P-4P and the 1P'-4P' (hereinafter referred to as the "effective nozzles 53*a*") are set such that the distance of each 1P-4P in the paper-conveying direction B and the distance of each 1P'-4P' in the paper-conveying direction B is equivalent to one period of the sine wave S, i.e. the circumference L of the conveying roller 60 (two times (an even multiple) of the semi-circumference L/2 of the conveying roller 60).

By recording the 1P-4P in one unit of conveyance and the 1P'-4P' in the next unit of conveyance, where one unit of Conveyance comprises three small feeds and one large feed, the same deviation is produced between the 1P and 1P', the 2P and 2P', the 3P and 3P', and the 4P and 4P', Accordingly, the printer 1 can form high-quality images, even when the conveying distances of the recording paper P have the error indicated by the sine wave S.

The example in FIG. 4A shows a case in which the error in the conveying distance of the recording paper P is 0 for the 1P and 1P'. In other words, when the recording paper P is conveyed after recording the 1P and 1P', the conveying roller 60 begins to rotate from the rotating start position. Since the error in conveying distance is 0 for the first of four conveying operations in a unit of conveyance in this example, the printer 1 can form a high-quality image. However, it is not always necessary to record with an error of 0 in the recording distance of the recording paper P for the 1P and 1P'.

For example, the printer 1 may begin recording the 1P and 1P' from positions corresponding to the 4P and 4P'. In other words, the deviation will not differ between the 1P and 1P', the 2P and 2P', the 3P and 3P' and the 4P and 4P' as long as the number of nozzles used in the recording operation is set to an even multiple of the semi-circumference L/2 of the conveying roller 60. Hence, the process for aligning the 1P and 1P' with a position at which the error in conveying distance is 0 may be omitted.

While FIGS. 4A and 4B show an example in which the number of effective nozzles is set to twice the semi-circumference L/2 of the conveying roller 60, the number of nozzles may instead by set to an even multiple of the semi-circumference L/2 of the conveying roller 60 or the closest approximation thereof.

A specific example is described with reference to FIG. 4B. As shown in FIG. 4B, the deviations of the lines 1P, 2P, 3P, and 4P from the reference position are 0, d2, d3, and d4, respectively. Similarly, the deviations of the lines 1P', 2P', 3P', and 4P' from the reference position are also 0, d2, d3, and d4, respectively. Accordingly, as described above, the same deviation is produced between the 1P and 1P', the 2P and 2P', the 3P and 3P', and the 4P and 4P', allowing the printer 1 to form high-quality images.

Note that each of three small feeds for sequentially forming the lines 1P-4P has a feed amount f, and a nozzle pitch b is four times the feed amount f (b=4f). In the example of FIG. 4B, the number of effective nozzles (used nozzles) is set to 13, such that the length in the subscanning direction corresponding to the number of effective nozzles is the closest approximation of an even multiple of the semi-circumference L/2 of the conveying roller 60.

Next, a recording method different from that in FIGS. 4A and 4B will be described with reference to FIG. 5. FIGS. 4A and 4B describe an example in which the number of nozzles used in a recording operation is set to an even multiple of the semi-circumference L/2 of the conveying roller 60. The recording method shown in FIG. 5 sets the number of nozzles used in a recording operation to an odd multiple of the semi-circumference L/2 of the conveying roller 60. In the example of FIG. 5, the number of effective nozzles has been set to one times (an odd multiple) of the semi-circumference L/2 of the conveying roller 60.

As shown in FIG. 5, while conveying error is produced when recording each of the 2P and 2P', 3P and 3P', and 4P and 4P', but not the 1P and 1P', when the number of effective nozzles is set to an odd multiple of the semi-circumference L/2 of the conveying roller 60, the error in conveying distance is 0 for 1P and 1P'. Accordingly, the conveying distance of the recording paper P has 0 error for one of the four conveying operations in one unit of conveyance, enabling the printer 1 to form images of a higher quality than when the error in conveying distance is not 0 for any recording operations in the unit of conveyance.

FIG. 5 describes an example in which the number of effective nozzles is set to one times the semi-circumference L/2 of the conveying roller 60. However, the number of effective nozzles may instead be set to an odd multiple of the semi-circumference L/2 of the conveying roller 60 or the closest approximation thereof.

Next, a printing process executed by the color inkjet printer 1 having the above structure will be described with reference to FIG. 6, FIG. 6 is a flowchart illustrating steps in the printing process that the printer 1 executes based on the print control program 33*a*. The printer 1 executes this printing process to form an image on one sheet of recording paper P by repeatedly performing a recording operation for ejecting ink toward the recording paper P while the inkjet head 6 is reciprocated in the main scanning direction, and a conveying operation to convey the recording paper P in the subscanning direction (conveying direction).

In the embodiment, the nozzles 53*a* have a nozzle pitch of 150 dpi. In the following description, recording is performed according to a requested recording density of 600 dpi in the subscanning direction in which one unit of conveyance is a combination of conveying the recording medium three times at the first conveying amount and subsequently conveying the recording medium one time at the second conveying amount greater than the first conveying amount. The printing process in FIG. 6 indicates the steps performed after print data has been received from the PC 100 connected to the printer 1.

In S601 of the process shown in FIG. 6, the CPU 32 acquires print data stored in the printing information memory area 34*a*. In S602 the CPU 32 acquires the pitch of the nozzles 53*a* as print head information and the circumference L of the conveying roller 60 (drive roller 60*a*) as conveying roller information stored in the design value memory 35*a*.

In S603 the CPU 32 calculates a number of effective nozzles Q based on information acquired in S601 and S602. The number of effective nozzles Q is set to the maximum number that satisfies the following equation (1), where M is a natural number, P is the pitch of the nozzles 53*a*, and L is the circumference of the conveying roller 60. Here, the number of effective nozzles 2 must be less than or equal to the number of nozzles of the inkjet head 6 in the subscanning direction.

$$Q=M\times 1/P\times L/2 \quad (1)$$

Equation (1) may also be expressed as the following equation (2), where INT(x) is an integer function that is a function for truncating digits after decimal point. With equation (2), the number of effective nozzles Q is set to a value closest to an even multiple or an odd multiple of the semi-circumference L/2 of the conveying roller.

$$Q=INT(M\times 1/P\times L/2+0.5) \quad (2)$$

In S604 the CPU 32 determines whether the natural number M is an even number after setting the number of effective nozzles Q according to equation (1) or (2) described above. In other words, the CPU 32 determines whether the number of effective nozzles Q is an even multiple or an odd multiple of the semi-circumference L/2 of the conveying roller 60. If the natural number N is found to be even (S604: YES), then in S605 the CPU 32 sets the conveying roller period flag 35*b* to "off" and advances to the printing process in S608.

However, if the natural number M is odd (S604: NO), then in S606 the CPU 32 sets the conveying roller period flag 35*b* to "on". In S607 the CPU 32 reads the rotating start position data for the conveying roller 60 from the design value memory 35*a* and adjusts the conveying roller 60 based on this rotating start position data so that the conveying roller 60 begins rotating from the rotating start position when conveying the recording paper after recording the initial dots (lines 1P and 1P' in FIG. 5). The CPU 32 performs this adjustment by controlling the linefeed motor 40 to rotate the conveying roller 60 until the rotating start position is aligned with a predetermined position. By executing the process in S607, the initial dots (lines 1P and 1P') in each unit of conveyance can be recorded at a position in which the conveying distance of the recording paper P has an error of 0.

In the printing process of S608, the CPU 32 drives the linefeed motor 40 to convey the recording paper P accommodated in the paper cassette 3 to a printable position with the pickup roller 59*b*, the conveying rollers 60, and the like; and performs recording operations by units of conveyance. After completing the recording process, in S609 the CPU 32 discharges the recording paper P and ends the printing process.

In the printer 1 according to the embodiment described above, the same deviations are produced between 1P and 1P', 2P and 2P', 3P and 3P', and 4P and 4P' when recording 1P-4P in one unit of conveyance and 1P'-4P' in the next unit of conveyance, if the number of effective nozzles 53*a* is set to an even multiple of the semi-circumference L/2 of the conveying roller 60. Accordingly, the printer 1 can form high-quality images, even when the conveying distance of the recording paper P has an error indicated by the sine wave S.

On the other hand, if the number of effective nozzles 53*a* is set to an odd multiple of the semi-circumference L/2 of the conveying roller 60, the CPU 32 performs an adjustment in S607 of FIG. 6 so that the conveying distance of the recording paper P has 0 error at the position of the image initially recorded in each unit of conveyance. Hence, the conveying distance of the recording paper P has 0 error for one out of four recording operations in one unit of conveyance, enabling the printer 1 to form images of a higher quality than when the error in conveying distance is never 0 in one unit of conveyance.

While the invention has been described in detail with reference to the above aspects thereof, it would be apparent to those skilled in the art that various changes and modifications may be made therein without departing from the scope of the claims.

In the embodiment described above, the CPU 32 adjusts the rotating start position of the conveying roller in S607 of FIG. 6 only when the number of effective nozzles 53*a* is set to an odd multiple of the semi-circumference L/2 of the conveying roller 60. However, the printer 1 may be configured to adjust the rotating start position also when the number of effective nozzles 53*a* is set to an even multiple of the semi-circumference L/2 of the conveying roller 60. In this case, 0 error in the conveying distance is achieved once in each unit of conveyance, enabling the printer 1 to record images of even higher quality.

In S603 of FIG. 6 in the embodiment described above, the CPU 32 sets the number of effective nozzles 53*a* to either an even multiple or an odd multiple of the semi-circumference L/2 of the conveying roller 60. However, the printer 1 may be configured to set the number of effective nozzles 53*a* only to an even multiple of the semi-circumference L/2 of the conveying roller 60, for example, rather than setting the number to one of the two.

In the embodiment described above, a color inkjet printer is described as an example of the image forming apparatus. However, the image forming apparatus may also be a dot impact printer, a thermal printer, or the like.

What is claimed is:

1. An image forming apparatus comprising:

a recording unit movable in a first direction and having a plurality of dot forming portions arranged in a predetermined interval in a second direction that intersects the first direction;

a conveying roller that conveys the recording medium in the second direction, the recording unit and the conveying roller being configured in such a manner that recording operations by the recording unit and conveying operations by the conveying roller are repeated for forming an image on a recording medium; and a setting unit that sets a number of effective dot forming portions used in a single recording operation such that a length in the second direction corresponding to the number of effective dot forming portions equals to either an even number times one half of circumference of the conveying roller or a value that is closest to an even number times one half of circumference of the conveying roller, when a required interval of dots formed on the recording medium in the second direction is less than or equal to one half of the predetermined interval.

2. The image forming apparatus according to claim 1, wherein the setting unit sets the number of effective dot forming portions so that the number of effective dot forming portions is a maximum number within the plurality of dot forming portions of the recording unit.

3. The image forming apparatus according to claim 1, further comprising a conveying control unit that controls the conveying roller to convey the recording medium a plurality of times at a unit of conveyance, when the required interval of the dots formed on the recording medium in the second direction is less than or equal to one half or the predetermined interval, the unit of conveyance being combination of conveying the recording medium at least one time at a first conveying amount and subsequently conveying the recording medium one time at a second conveying amount greater than the first conveying amount.

4. The image forming apparatus according to claim 1, further comprising:

a storage unit that stores information of a rotating start position of the conveying roller, the conveying roller producing error in a conveying distance of the recording medium during one rotation from the rotating start position, the error changing in a shape of one cycle of a sine curve, the error being set to zero at the rotating start position; and an adjusting unit that adjusts the conveying roller based on the information of the rotating start position so that the conveying roller begins rotating from the rotating start position when conveying the recording medium after recording initial dots in each unit of conveyance.

5. An image forming apparatus comprising:

a recording unit movable in a first direction and having a plurality of dot forming portions arranged in a predetermined interval in a second direction that intersects the first direction;

a conveying roller that conveys the recording medium in the second direction, the recording unit and the conveying roller being configured in such a manner that recording operations by the recording unit and conveying operations by the conveying roller are repeated for forming an image on a recording medium; and a setting unit that sets an number of effective dot forming portions used in a single recording operation such that a length in the second direction corresponding to the number of effective dot forming portions equals to either an odd number times one half of circumference of the conveying roller or a value that is closest to an odd number times one half of circumference of the conveying roller, when a required interval of dots formed on the recording medium in the second direction is less than or equal to one half of the predetermined interval.

6. The image forming apparatus according to claim 5, wherein the setting unit sets the number of effective dot forming portions so that the number of effective dot forming portions is a maximum number within the plurality of dot forming portions of the recording unit.

7. The image forming apparatus according to claim 5, further comprising a conveying control unit that controls the conveying roller to convey the recording medium a plurality of times at a unit of conveyance, when the required interval of the dots formed on the recording medium in the second direction is less than or equal to one half of the predetermined interval, the unit of conveyance being combination of conveying the recording medium at least one time at a first conveying amount and subsequently conveying the recording medium one time at a second conveying amount greater than the first conveying amount.

8. The image forming apparatus according to claim 5, further comprising:

a storage unit that stores information of a rotating start position of the conveying roller, the conveying roller producing error in a conveying distance of the recording medium during one rotation from the rotating start position, the error changing in a shape of one cycle of a sine curve, the error being set to zero at the rotating start position and an adjusting unit that adjusts the conveying roller based on the information of the rotating start position so that the conveying roller begins rotating from the rotating start position when conveying the recording medium after recording initial dots in each unit of conveyance.

9. An image forming apparatus comprising:

a recording unit movable in a first direction and having a plurality of dot forming portions arranged in a predetermined interval in a second direction that intersects the first direction;

a conveying roller that conveys the recording medium in the second direction, the recording unit and the conveying roller being configured in such a manner that recording operations by the recording unit and conveying operations by the conveying roller are repeated for forming an image on a recording medium; and a setting unit that, when a required interval of dots formed on the recording medium in the second direction is less than or equal to one half of the predetermined interval, sets a number Q of effective dot forming portions used in a single recording operation to a maximum number that satisfies an equation:

$$Q=M\times 1/P\times L/2$$

where M is a natural number, P is the predetermined interval of the plurality of dot forming portions, and L is the circumference of the conveying roller, the number Q of effective dot forming portions being less than or equal to the number of the plurality of dot forming portions in the second direction.

10. The image forming apparatus according to claim 9, further comprising a conveying control unit that controls the conveying roller to convey the recording medium a plurality of times at a unit of conveyance, when the required interval of the dots formed on the recording medium in the second direction is less than or equal to one half of the predetermined interval, the unit of conveyance being combination of conveying the recording medium at least one time at a first conveying amount and subsequently conveying the recording medium one time at a second conveying amount greater than the first conveying amount.

11. The image forming apparatus according to claim 9, further comprising:

a storage unit that stores information of a rotating start position of the conveying roller, the conveying roller producing error in a conveying distance of the recording medium during one rotation from the rotating start position, the error changing in a shape of one cycle of a sine curve, the error being set to zero at the rotating start position; and an adjusting unit that adjusts the conveying roller based on the information of the rotating start position so that the conveying roller begins rotating from the rotating start position when conveying the recording medium after recording initial dots in each unit of conveyance.

12. The image forming apparatus according to claim 11, further comprising:

a motor that rotates the conveying roller; and a carriage that supports the recording unit, wherein the rotating start position is determined and stored by:

driving the motor to rotate the conveying roller for one and half rotations, while the motor is stopped at each predetermined angle and a carriage is scanned in the first direction to print a horizontal line on a recording medium, thereby forming a plurality of horizontal lines on the recording medium;

placing the recording medium on which the plurality of horizontal lines is formed on an optical image evaluation apparatus;

measuring pitches between adjacent horizontal lines by the optical image evaluation apparatus;

plotting the measured pitches for one rotation of the conveying roller and approximating the measured pitches by a sine curve;

determining, based on the sine curve, a step number of the motor corresponding to an angle of either zero or pi; and storing the step number in the storage unit as the information of the rotating start position.

13. The image forming apparatus according to claim 9, further comprising:

a determining unit that determines whether the natural number M is an even number or an odd number after the setting unit sets the number Q of effective dot forming portions; and an adjusting unit that, when the determining unit determines that the natural number M is an odd number, adjusts the conveying roller based on the information of the rotating start position so that the conveying roller begins rotating from the rotating start position when conveying the recording medium after recording initial dots in each unit of conveyance.

* * * * *

UNITED STATES PATENT AND TRADEMARK OFFICE

CERTIFICATE OF CORRECTION

PATENT NO. : 7,445,329 B2
APPLICATION NO. : 11/939987
DATED : November 4, 2008
INVENTOR(S) : Yasunari Yoshida It is certified that error appears in the above-identified patent and that said Letters Patent is hereby corrected as shown below:

Title Page:

Item 30 Foreign Application Priority data was omitted it should read as follows.

Foreign Application Priority Data

November 14, 2006 (JP).....2006-307506

Signed and Sealed this

Ninth Day of February, 2010

David J. Kappos

David J. Kappos
*Director of the United States Patent and Trademark Office*